US005581811A

United States Patent [19]

Cohen et al.

[11] Patent Number: 5,581,811

[45] Date of Patent: Dec. 10, 1996

[54] PROTECTIVE GLOVE

[76] Inventors: Carl J. Cohen; Jack Cohen, both of 909 Woodward Ave., Suite 101, Pontiac, Mich. 48341

[21] Appl. No.: 512,104

[22] Filed: Aug. 7, 1995

[51] Int. Cl.[6] ..... A41D 13/10

[52] U.S. Cl. ..... 2/161.7; 2/167

[58] Field of Search ..... 2/159, 161.7, 167, 2/169, 161.6, 168, 16, 161.8

[56] References Cited

U.S. PATENT DOCUMENTS

| | | | |
|---|---|---|---|
| 3,526,473 | 9/1970 | Burgett et al. | 8/94.12 |
| 3,766,564 | 10/1973 | Varley | 2/161.1 |
| 4,084,265 | 4/1978 | Anfelt | 2/167 |
| 4,881,277 | 11/1989 | Hogle | 2/161.7 |
| 4,942,626 | 7/1990 | Stern et al. | 2/161.7 |
| 5,079,776 | 1/1992 | Crawford | 2/162 |
| 5,187,815 | 2/1993 | Stern et al. | 2/161 R |
| 5,200,364 | 4/1993 | Gould et al. | 428/323 |
| 5,231,700 | 8/1993 | Cutshall | 2/161.7 |
| 5,317,759 | 7/1994 | Pierce | 2/161.7 |
| 5,335,373 | 8/1994 | Dangman et al. | 2/161.7 |
| 5,357,636 | 10/1994 | Dresdner, Jr. et al. | 2/161.7 |
| 5,368,930 | 11/1994 | Samples | 428/323 |

*Primary Examiner*—Amy B. Vanatta
*Attorney, Agent, or Firm*—Gifford, Krass, Groh, Sprinkle, Patmore, Anderson & Citkowski, P.C.

[57] ABSTRACT

A protective glove for preventing inadvertent needle punctures of a health care worker's hand is fabricated from shark skin or other such leather having a surface covered with placoid scales. The protective glove may be used in combination with a barrier glove fabricated from latex or the like. The protective glove is highly resistant to needle punctures, but is relatively thin and preserves tactile sensations.

16 Claims, 2 Drawing Sheets

PROTECTIVE GLOVE

I. FIELD OF THE INVENTION

This invention relates generally to protective apparel. More specifically, the invention relates to a glove structure for protecting a user's hand from inadvertent needle puncture.

II. BACKGROUND OF THE INVENTION

Medical personnel are at a significant risk of contracting a communicable disease from a patient, as a result of the transfer of infectious material through an inadvertent needle puncture. There are a number of documented cases of the transmission of AIDS, Hepatitis B and other blood borne diseases, resultant from the transfer of blood or other body fluids through an accidental needle puncture occuring in the course of a medical procedure. The problem of needle punctures is particularly significant in a surgical setting, and it has been documented that inadvertent needle punctures occur in as many as 40% of all operative procedures.

The prior art has implemented a number of approaches to preventing or minimizing disease transmission resultant from needle puncture; however, none of these approaches have proven satisfactory. Presently, many surgical personnel employ double gloving wherein two latex gloves are placed on each hand. This approach provides some resistance to needle punctures; however, in view of the fact that the surgical gloves are quite thin, the extra protection resultant therefrom is fairly minimal. A number of surgeons often employ cut resistant undergloves fabricated from a metal, or high strength polymer, mesh. These gloves can prevent scalpel cuts, but the open structure thereof provides little protection from needle penetration. In addition, such mesh gloves are relatively thick and limit tactile sensations, which can be quite important in surgery.

U.S. Pat. Nos. 4,942,626 and 5,187,815 both disclose puncture resistant gloves which are preferably fabricated from cabretta leather, which is a soft leather prepared from the skins of hairy sheep. Both patents also note that other materials such as calfskin, buckskin and kangaroo leather, as well as urethane resin impregnated fabric may be utilized to provide puncture resistance. Gloves of this construction must be made relatively thick in order to provide a sufficient degree of puncture resistance. U.S. Pat. Nos. 5,200,263 and 5,368,930 both disclose gloves fabricated from elastomeric material having relatively rigid, puncture resistant plates embedded therein. Presence of the plates limits the flexibility of the gloves, decreases tactility and complicates manufacture. U.S. Pat. Nos. 5,335,373 and 5,357,636 disclose yet another approach to the problem, wherein a dual layered glove structure is provided which has an antibiotic material disposed between the two glove layers. In the instance of puncture, the antibiotic is released so as to sterilize the wound site.

It will be appreciated from the foregoing, that there is a significant need for a protective glove for preventing or minimizing needle puncture of a health care worker's hand, and that the prior art has implemented a number of approaches thereto. The structures of the prior art have not provided a satisfactory solution to this need. Gloves of the prior art are fairly complex in structure, which makes them difficult and expensive to fabricate and hard to use. In addition, the prior art gloves are relatively thick and tend to limit tactile sensations.

It will therefore be appreciated that there is a need for a glove which can function to protect a health care worker from needle punctures, and that, in addition to being effective, the glove should be relatively thin so as to preserve tactile sensation. In addition, the glove should be simple in construction, easy to fabricate, and low in cost. The present invention, as will be described in greater detail herein below, is directed to a simple, lowcost glove structure which effectively prevents needle punctures. It has been found, in accord with the present invention, that certain leathers, prepared from the skin of cartilaginous fishes (chondrichthyes) are surprisingly resistant to needle puncture, and may be used to fabricate protective gloves. As will be described in greater detail herein below, these gloves are light in weight, thin and highly effective. These and other advantages of the present invention will be readily apparent from the drawings, discussion and description which follows.

BRIEF DESCRIPTION OF THE INVENTION

There is disclosed herein a puncture resistant glove structure for protecting the hands of a health care worker from inadvertent, needle penetration. The glove structure includes a protective glove fabricated from a leather prepared from the skin of a chondrichthye and having a surface covered with placoid scales. The protective glove is configured to enclose at least a portion of a user's hand. The glove structure further includes a barrier glove fabricated from an elastomeric material and configured to cover substantially all of an exterior surface of the protective glove. Most preferably the protective glove is fabricated from leather prepared from the skin of sharks, rays or skates, and is preferably in the thickness range of 0.02–0.05 inches. In some embodiments, portions of the glove may be cut out so as to expose the user's fingertips. Certain portions of the glove, such as the portion covering the back of the hand, may be made of double thicknesses of leather. In certain embodiments, the protective glove is provided with a macroscopically textured surface to further enhance its resistance to needle penetration. This macroscopically textured surface may comprise a series of needle deflecting projections, or a series of needle trapping invaginations.

The present invention also is directed to a method for preventing inadvertent needle puncture of health care worker's hand. The method includes the step of protecting the hand with a glove fabricated from the chondrichthye skin leather, and may or may not include the further step of covering the protective glove with the elastomeric barrier glove.

DETAILED DESCRIPTION OF THE INVENTION

It has been found, in accord with the principles of the present invention, that leather prepared from the skins of sharks, skates and rays is particularly resistant to needle punctures. These cartilaginous fishes are classified as chondrichthyes, and their skin is characterized by the presence thereupon of a large number of small, closely packed placoid scales. The placoid scales are hard, flat, generally triangular, overlapping, toothlike structures which are tightly adhered to the underlying skin and which are notable in that they include a pulp channel therein similar to that found in teeth. As a result, shark skin leather is highly flexible, but has a very hard surface resistant to needle puncture. In addition, the scales tend to deflect and trap the point of a needle further enhancing penetration resistance. As a result of the foregoing, shark skin gloves may be made relatively thin, thereby enhancing tactile sensation, but still will be resistant to needle penetration.

In the general context of this disclosure, the protective gloves are described as being fabricated from shark skin. It is to be understood that other members of the class have skins characterized by placoid scales, and accordingly, the skins of sharks, rays, dogfish and the like may also be employed in the practice of the present invention, to the extent that they include the placoid scale structure, and such materials fall within the general definition of shark skin.

Figure 1:
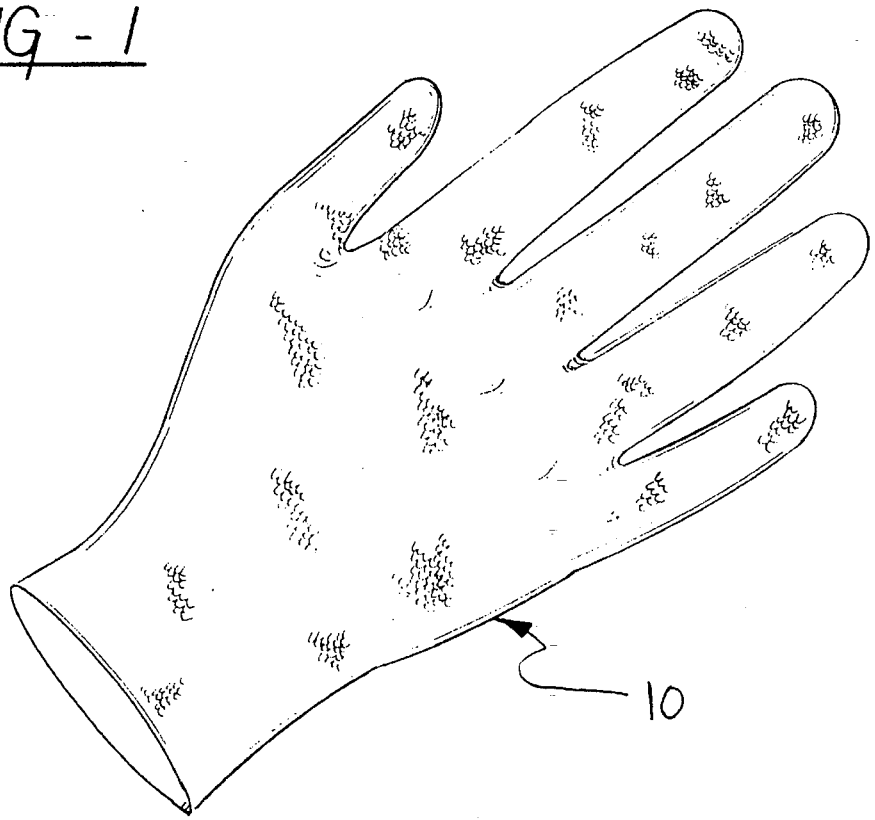
FIG. 1 is a perspective view of a protective glove which is structured in accord with the present invention.

Referring now to FIG. 1, there is shown a protective glove 10 structured in accord with the principles of the present invention. The glove 10 is fabricated from shark skin, and in this embodiment, is configured to cover substantially all of the user's hand from the wrist on down, although as will be described in greater detail herein below, other configurations are also within the scope of the present invention. The shark skin leather of the glove 10 of FIG. 1 will preferably be relatively thin so as to permit the wearer to maintain tactile sensation. It has been found that a good degree of puncture resistance will be obtained utilizing leather having a thickness in the range of 0.02–0.05 inches, although it is to be understood that portions of the glove where tactility is not essential, such as the back of the hand, may be made thicker, and regions of the hand which are less prone to needle puncture and/or which require higher tactility, such as the fingertips, may be cut away or made from relatively thinner leather.

In general, the protective glove 10 of FIG. 1 will be utilized in combination with a barrier glove which is fabricated from elastomeric material such as latex, and which will typically comprise a standard surgical glove. The barrier glove will cover the entirety of the protective glove 10 as well as any exposed portions of the wearer's hands and will provide a sterile barrier to the transmission of bacteria and virus. Although the protective glove of the present invention is a relatively low cost item, it is generally contemplated that it will be sterilized and reused a number of times, while the barrier glove will generally be a disposable item.

Figure 2:
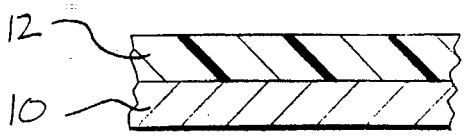
FIG. 2 is a cross-sectional view of a puncture resistant glove structure fabricated in accord with the principles of the present invention.

Referring now to FIG. 2, there is shown a cross-sectional view of a portion of a puncture resistant of structure of the present invention comprising a protective glove 10 and a barrier glove 12. Other elements may further be included in combination with the protective 10 and barrier 12 gloves of FIG. 2. For example, a viricide, bactericide or the like may be interposed between the two members to further prevent disease transmission. Also, mesh structures or other cut and puncture resistant layers may be interposed between all, or portions, of the two illustrated layers.

Figure 3:
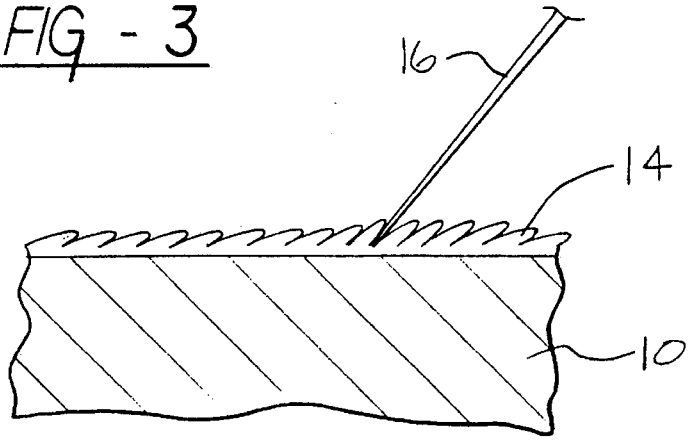
FIG. 3 is an enlarged, cross-sectional view of a portion of a protective glove of the present invention illustrating the action of the placoid scales in resisting needle puncture.

Referring now to FIG. 3, there is shown an enlarged, cross-sectional view of a portion of a shark skin glove 10 illustrating the placoid scales disposed in a layer 14 thereupon. As will be noted, these scales comprise a number of toothlike members oriented so as to lay flat against the skin. These scales are quite hard and present a strong barrier to needle puncture. As illustrated, a needle 16 encountering the protective glove 10 tends to be deflected by the scales, and trapped therebetween. In this manner, the leather comprising the glove 10 tends to wrinkle, thereby dissipating the energy of the needle 16. This combination of resistance, deflection, and energy absorption renders shark skin leather highly impervious to needle puncture.

Figure 4:
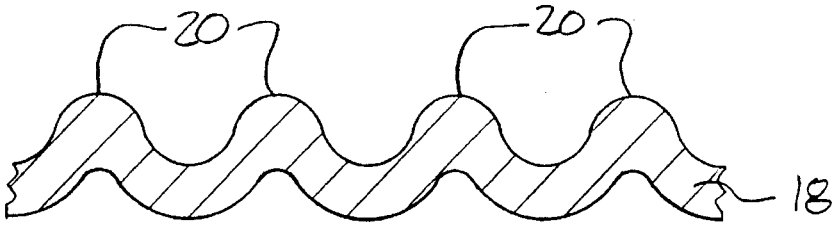
FIGS. 4–6 are cross-sectional views of various embodiments of protective glove structured in accord with the principles of the present invention, and illustrating the macroscopic texturing thereof.
Figure 5:
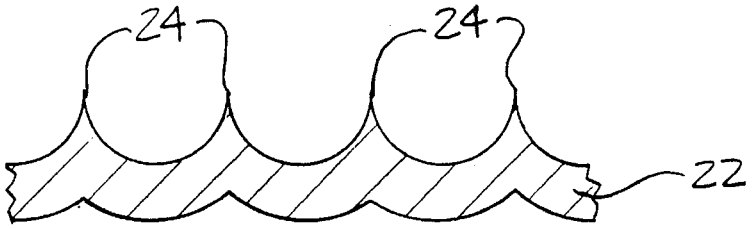
Figure 6:
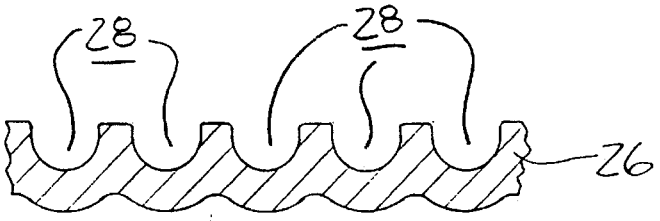

The puncture resistance of the leather may be further enhanced by providing a macroscopic texture thereto. This texture will operate, in combination with the microscopic texture of the placoid scales so as to further enhance the needle deflecting and trapping abilities of the glove. FIG. 4 depicts a cross-sectional view of a portion of another glove 18 structured in accord with the present invention. The glove 18 of FIG. 4 includes a series of sinusoidal ridges 20 formed thereupon as for example, by embossing. These ridges 20 work to deflect a needle thereby enhancing puncture resistance. FIG. 5 depicts yet another protective glove 22 having a macroscopic texture comprised of a plurality of sharp pointed ridges 24 which also function to deflect a needle. FIG. 6 depicts a portion of yet another glove 26 including a plurality of invaginations 28. These pockets function to trap and hold a needle, particularly in the instance where the needle is moving at an angular relationship to the surface of the glove 26. It is to be understood that other macroscopic textures, such as pebbled textures and the like may be similarly employed, and the textured regions of the glove are preferably disposed upon those portions thereof which do not require a high degree of tactile sensitivity, such as the back of the hand and the like.

Figure 7:
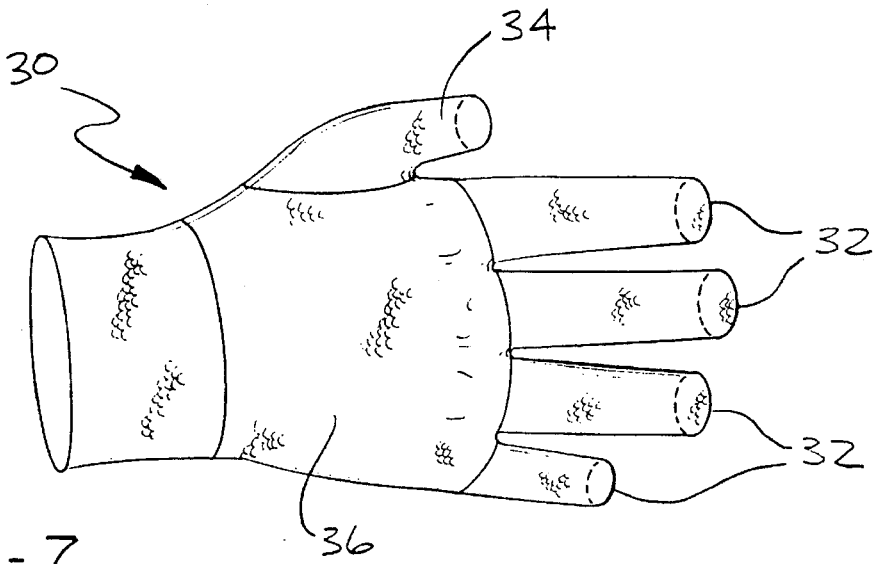
FIG. 7 is a perspective view of another embodiment of protective glove structured in accord with the principles of the present invention.

The protective glove of the present invention may be fabricated in a variety of configurations provided it functions to protect at least a portion of the user's hand. Referring now to FIG. 7, there is shown a perspective view of another embodiment of protective glove 30 structured in accord with the present invention. The glove 30 of FIG. 7 is a right handed glove, and it will be noted that the tips of the fingers 32 are cut away. In this manner, tactile sensations to the fingertips are not inhibited. In alternative embodiments, glove may be configured so as to cover the top of each finger, but leave the finger pad portion of each fingertip uncovered. In the illustrated embodiment, the thumb 34 is not completely covered, but in alternative embodiments the thumb may be completely or partially exposed. As illustrated, the glove 30 of FIG. 7 includes an extra layer of leather 36 disposed so as to cover the back of the user's hand. A similar additional layer of leather may be added to cover all, or a portion of the palm. The additional leather in these areas will not adversely interfere with tactile sensation, and it has been found that a large number of accidental needle punctures occur in these areas. The additional leather is preferably a layer of shark skin leather, although other materials, including synthetics or composites may be employed. A number of other configurations of protective glove may be implemented in accord with the present invention. The prior art discloses a number of glove structures including various cut-away finger portions and the like, and all of such prior art glove structures may be implemented in fabrication of the protective glove of the present invention.

The glove system of the present invention provides a high degree of protection from inadvertent needle punctures, but still permits a large degree of tactile sensation. The glove system is applicable to a variety of health care situations including surgery, examination and treatment, as well as post-mortem work. In most instances, the protective glove will be used in combination with a barrier glove so as to limit the cross-transmission of organisms. Those instances where maintenance of a sterile field is not essential, the barrier glove may be dispensed with, although there may be advantage to its use insofar as it prevents undue contamination of the protective glove which is preferably sterilized and reused.

In view of the teaching herein, it is to be understood that the invention may be practiced in a number of forms and variations other than illustrated and described. The foregoing drawings, discussion and description are clearly meant to illustrate particular embodiments of the invention, and are not meant to be limitations upon the practice thereof. It is the following claims, including all equivalents, which define the scope of the invention.

We claim:

1. A method for protecting the hand of a health care worker from inadvertent needle punctures comprising:

providing a protective glove fabricated from a leather prepared from the skin of a chondrichthye and having a surface which is covered with placoid scales;

disposing said glove on a hand so as to cover at least a portion thereof, whereby said placoid scales causing the surface of said leather to be resistant to puncture by a needle; and covering said protective glove with a barrier glove fabricated from an elastomeric material.

2. A method as in claim 1, wherein said protective glove is fabricated from the skin of a chondrichthye selected from the group consisting of: sharks, rays and skates.

3. A method as in claim 1, wherein the step of providing a protective glove comprises providing a glove fabricated from a leather having a thickness in the range of 0.02–0.05 inches.

4. A method as in claim 1, wherein the step of providing a protective glove comprises providing a glove which does not cover all of the finger pads of said hand.

5. A method as in claim 1, wherein the step of providing a protective glove comprises providing a glove having a dual layer of said leather forming those portions thereof which cover the back of said hand when the glove is disposed thereupon.

6. A method as in claim 1, wherein the step of providing a protective glove comprises providing a glove in which at least a portion of the surface thereof is macroscopically textured.

7. A method as in claim 6, wherein the step of providing a glove wherein at least a portion of the surface is macroscopically textured, comprises providing a glove in which at least a portion of the surface thereof includes a series of projections.

8. A method as in claim 6, wherein the step of providing a glove wherein at least a portion of the surface thereof is textured, comprises providing a glove wherein at least a portion of the surface thereof includes a series of invaginations.

9. A glove structure for protecting the hand of a health care worker from inadvertent needle puncture comprising:

a protective glove fabricated from a leather prepared from the skin of a chondrichthye and having a surface which is covered with placoid scales, said glove configured to enclose at least a portion of a hand; and a barrier glove fabricated from an elastomeric material, said barrier glove configured to cover substantially all of an exterior surface of said protective glove when said protective glove is disposed upon said hand.

10. A glove structure as in claim 9, wherein said protective glove is fabricated from the skin of chondrichthye selected from the group consisting of: sharks, rays, and skates.

11. A glove structure as in claim 9, wherein said protective glove is fabricated from a leather having a thickness in the range of 0.02–0.05 inches.

12. A glove structure as in claim 9, wherein said protective glove is configured so as to expose at least some of the finger pads of said hand when disposed thereupon.

13. A glove structure as in claim 9, wherein said protective glove is fabricated to include a double thickness of said leather on the portions thereof which cover the back of the hand when the glove is disposed thereupon.

14. A glove structure as in claim 9, wherein at least a portion of the protective glove is provided with a macroscopically textured surface.

15. A glove structure as in claim 14, wherein said macroscopically textured surface comprises a series of projections.

16. A glove structure as in claim 14, wherein said macroscopically textured surface comprises a series of invaginations.

* * * * *